United States Patent [19]

Clark

[11] Patent Number: 4,941,238

[45] Date of Patent: Jul. 17, 1990

[54] SLIDE FASTENERS AND THE LIKE

[75] Inventor: David F. Clark, Broseley, England

[73] Assignee: Allison E. Anderson, Great Britain

[21] Appl. No.: 154,988

[22] Filed: Feb. 11, 1988

[30] Foreign Application Priority Data

Feb. 13, 1987 [GB] United Kingdom ..... 8703439

[51] Int. Cl.[5] ..... A44B 19/32

[52] U.S. Cl. ..... 24/437; 24/389; 24/587

[58] Field of Search ..... 24/437, 438, 440, 587, 24/588, 578, 384, 389, 399, 410, 433; 383/63, 64, 65

[56] References Cited

U.S. PATENT DOCUMENTS

| | | | |
|---|---|---|---|
| 1,929,083 | 10/1933 | Sipe | 24/389 X |
| 2,107,216 | 2/1938 | Rogers | 24/389 X |
| 2,519,290 | 8/1950 | Saltz | 24/588 X |
| 2,869,207 | 1/1959 | Bernstein | 24/389 X |
| 3,416,199 | 12/1968 | Imamura | 24/587 |
| 3,490,109 | 1/1970 | Heimberger | 24/389 |
| 3,711,903 | 1/1973 | Brown | 24/389 X |
| 4,660,259 | 4/1987 | Ausnit | 24/587 |

FOREIGN PATENT DOCUMENTS

| | | | |
|---|---|---|---|
| 901041 | 1/1954 | Fed. Rep. of Germany | 24/389 |
| 807192 | 1/1937 | France | 24/389 |
| 364703 | 3/1939 | Italy | 24/389 |

*Primary Examiner*—Laurie K. Cranmer

*Attorney, Agent, or Firm*—Leydig, Voit & Mayer, Ltd.

[57] ABSTRACT

The device provides a fastener which somewhat resembles a slide fastener but which can be made at least substantially fluid-resistant. It comprises a first component (1), of flexible and resilient material, having an engagement formation having a longitudinal groove (6) and longitudinally spaced mating formations (10), and a second component (2), of similar material, having a rib (16) and longitudinally spaced mating formations (19). The components can be progressively engaged by the introduction of the rib into the groove and the interengagement of the mating formations. The latter prevent significant relative longitudinal movement between the components. Each component can be made by extrusion of a blank followed by the formation of the mating formations by a rotary die (123). The components can be engaged and disengaged by means of a slide (52) like that used in a conventional slide fastener. To prevent the inadvertent disengagement of the components, the component may have longitudinal retaining or locking formations (7,17) and/or interlocking mating formations (10,19). Numerous other examples are illustrated.

5 Claims, 9 Drawing Sheets

SLIDE FASTENERS AND THE LIKE

Figure 1:
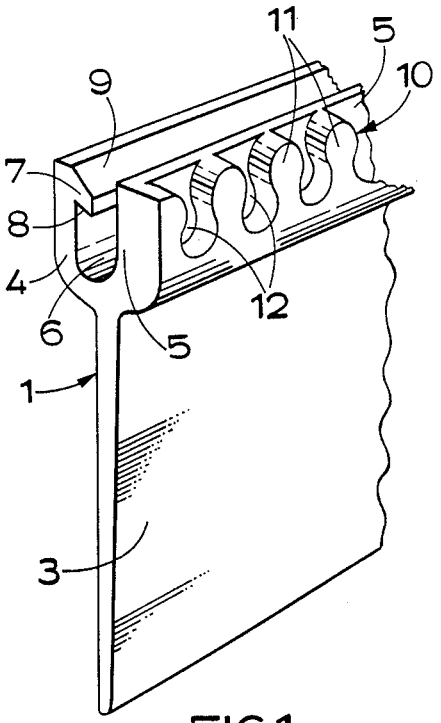

This invention relates to slide fasteners and the like.

A conventional slide fastener comprises two flexible components, each of elongated form, provided with teeth which can be caused to interengage, and can subsequently be parted, by the movement of a slide pulled along the components. Slide fasteners of that kind are satisfactory for many purposes but suffer from the disadvantage that in use, when the teeth have been interengaged they tend to allow water and other liquids, as well as gases, to pass between them.

There are numerous circumstances in which it would be desirable for a slide fastener to be fluid-resistant or at least substantially so, and the present invention stems from work undertaken with a view to providing a fastener which may be suitable for use in place of a conventional slide fastener but which can be made at least substantially fluid-resistant. In addition, however, the present invention also aims to produce other forms of fastener.

Another existing type of fastener, which is not a slide fastener, comprises two flexible components, each of elongated form, one of which is formed with a longitudinal groove and the other of which is provided with a longitudinal rib that can be snapped in and out of the groove, it normally being necessary to introduce the rib into the groove progressively, along the length of the fastener, and conversely to remove the rib from the groove progressively, along the length of the fastener. Fasteners of that kind are satisfactory for many purposes, such as providing re-usable seals on plastic bags, but are unsuitable for other purposes as the two components can slide lengthwise relative to each other in use when the rib is engaged in the groove.

With the aid of the present invention it is possible to provide a fastener such that this disadvantage is avoided.

From a first aspect the present invention consists in a fastener comprising a first component and a second component which can be releasably engaged with it, the first component having an elongated engagement formation made of a flexible and resilient material and comprising a longitudinally extensive groove and a plurality of longitudinally spaced mating formations, and the second component having an elongated engagement formation made of a flexible and resilient material and comprising a longitudinally extensive rib and a plurality of longitudinally spaced mating formations that interengage the mating formations of the first component, when the first and second components are engaged and the rib is disposed in the groove, so as to preclude major relative longitudinal movement between the components.

The first and second components preferably have complementary sealing surfaces of elongated form which come into engagement, when the components are engaged, to render the fastener at least substantially fluid-resistant.

The rib and groove are preferably so shaped as to interlock when the components are engaged and thus resist forces that may be applied to the fastener tending to separate the components by pulling the rib from the groove. To this end the groove preferably has a mouth narrower than the interior thereof, and a retaining portion of the rib is preferably wider than the mouth, so that the mouth has to be resiliently opened to allow the retaining portion of the rib both to enter and to leave the interior of the groove. The fastener may be such that the first component has a locking formation of hook-shaped or undercut cross-section projecting laterally into the groove, and the rib of the second component has a locking formation of complementary shape, the arrangement being such that, when the components are engaged and forces are applied to the fastener tending to separate the components by pulling the rib from the groove, the locking formations interengage so as positively to resist separation of the components.

The mating formations of each of the first and second components may comprise a row of spaced projections with recesses between them, the arrangement being such that when the components are engaged the projections of each component are received in recesses in the other component. In a preferred arrangement the mating formations of the first component are similarly shaped to the mating formations of the second component. The mating formations may be so shaped that they interlock when the components are engaged and thus resist forces that may be applied to the fastener tending to separate the components. In one preferred design the mating formations of the first component are provided inside the groove, and the complementary mating formations of the second component are on the rib.

In some designs of fastener, each of the components is of the same shape and form as the other. This makes it possible to manufacture only a single design of component and to form a fastener from two portions of the component.

Each of the two components is preferably formed from a plastics material. Each component may be made as a moulding but in a preferred arrangement at least one of the components is made in a process in which, in one step, material from which it is to be made is extruded through a die to form an extrusion and in a subsequent step the extrusion is shaped to afford mating formations. When the first component is made by that process, the extrusion may have portions that are initially spaced apart but, in a subsequent step and brought closer together to define the groove in the component. In the course of making the first component, the mating formations may be formed between the groove-defining portions before the groove-defining portions are brought to the positions they adopt in the finished component. The mating formations may be formed sequentially by applying at least one rotary die to the extrusion.

The fastener is preferably provided with a slide that can be slid to and fro along the components and in so doing is operative to cause the engagement and disengagement of the components, the fastener and slide thus together constituting a slide fastener.

A preferred method of making a component for a fastener in accordance with the invention comprises the steps of extruding material from which the component is to be made through a die to form an extrusion, and shaping the extrusion so that it affords mating formations. When it is the first component that is made by that method the extrusion preferably has spaced portions that in a subsequent step are brought closer together to define the groove in the component. The mating formations may be formed between the groove-defining portions before said subsequent step. In any of these methods, the mating formations are preferably formed by applying at least one rotary die to the extrusion.

From a second aspect the present invention consists in a component for a fastener in accordance with the first aspect of the present invention made by a method of the kind outlined in the last preceding paragraph.

From a third aspect the present invention consists in a fastener component having an elongated engagement formation made of flexible and resilient material and comprising a longitudinally extensive groove, a plurality of longitudinally spaced mating formations and a longitudinally extensive rib, the component being such that together with a fastener component of identical shape and form it can constitute a component of a fastener in accordance with the first aspect of the present invention.

A component may have a strip of flexible material by means of which the component may be attached to some other article such as a garment. That strip may be extruded in the first step. The strip and the engagement formation may be made from the same material but if desired one of them may be made of a material having properties different from those of the material from which the other is made. For example the strip may be made of a material which is harder or softer than the material from which the engagement formation is made. Where materials having different properties are employed in this way they may be simultaneously extruded during the first stage so that they become permanently united. The process may therefore be of the kind referred to as a co-extrusion process.

Figure 2:
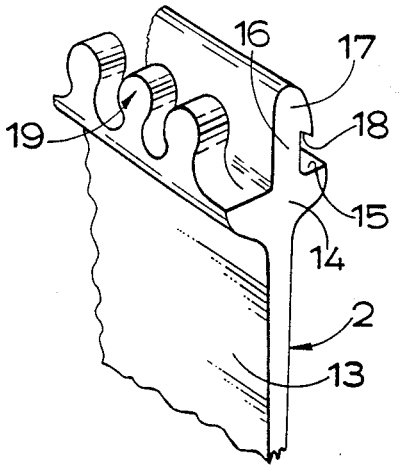
Figure 3:
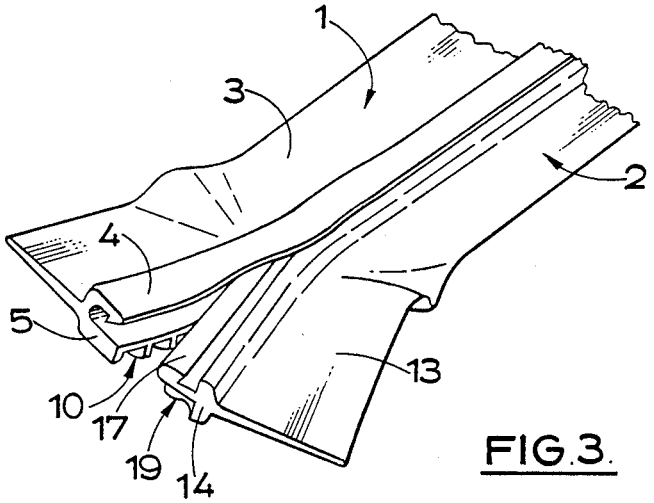
Figure 5:
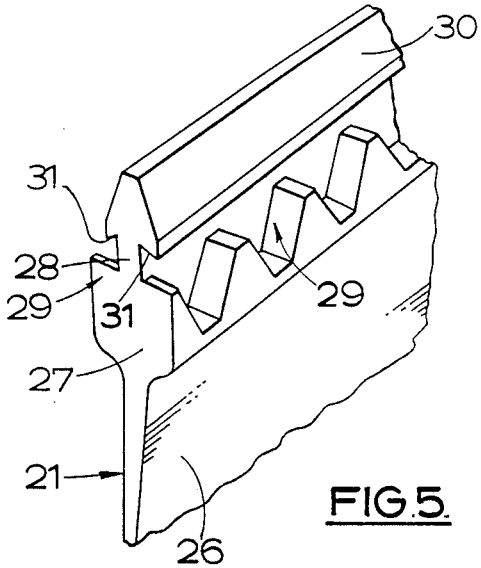
Figure 6:
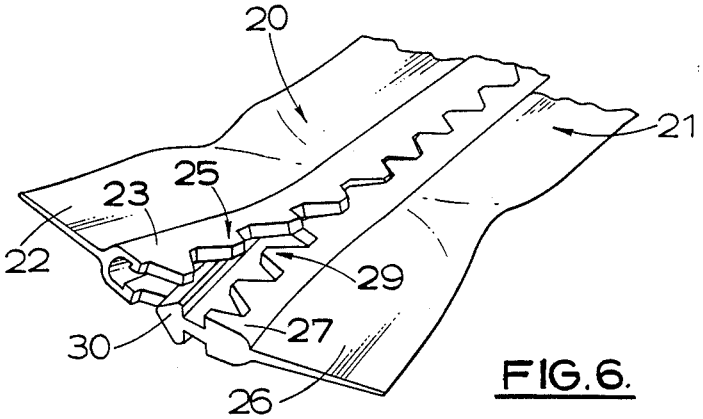
Figure 7:
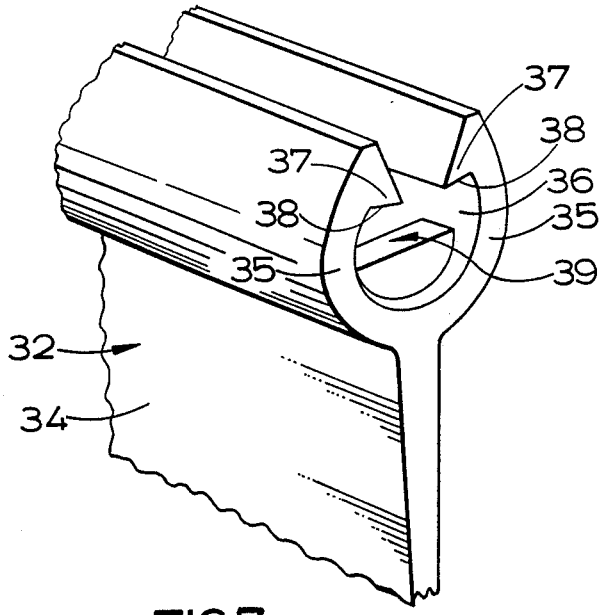
Figure 8:
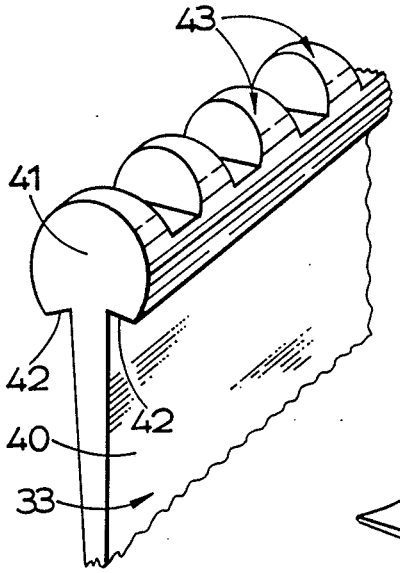
Figure 9:
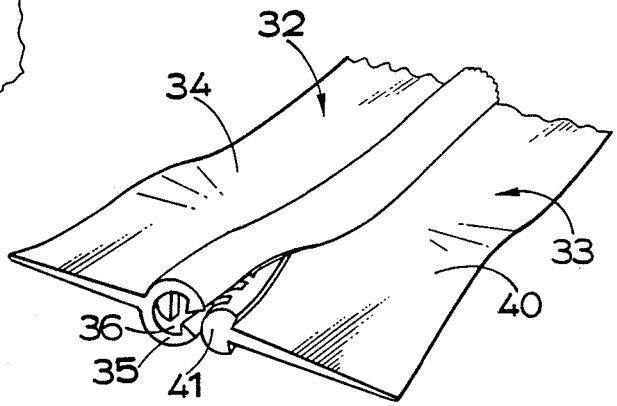
Figure 10:
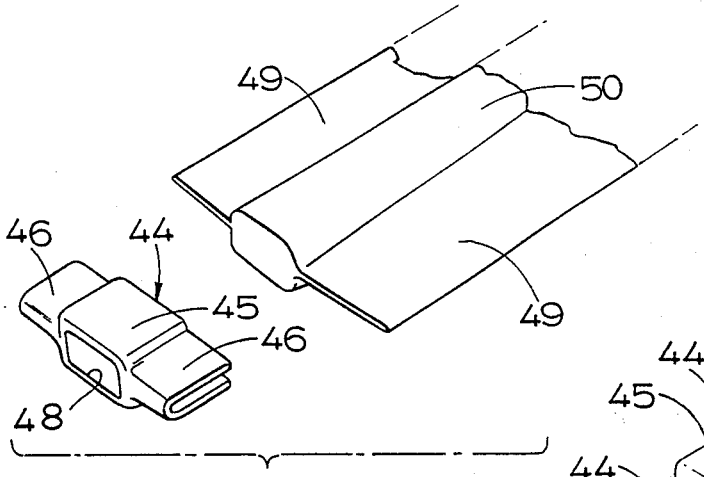
Figure 11:
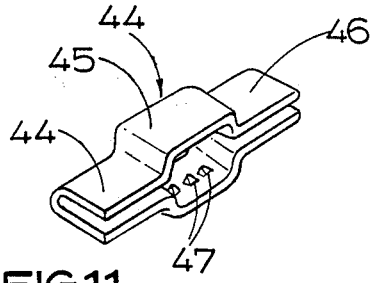
Figure 12:
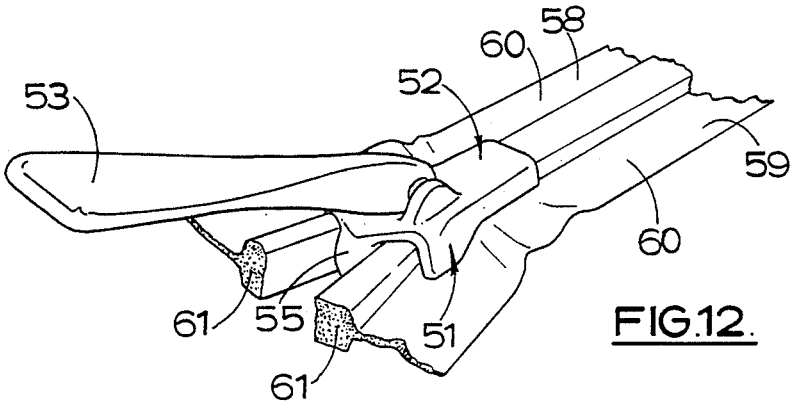
Figure 13:
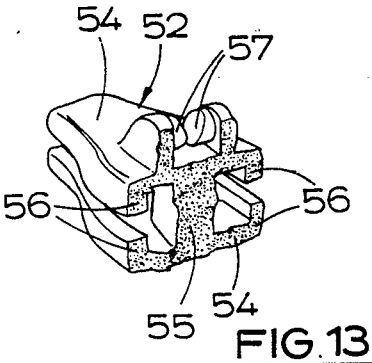
Figure 14:
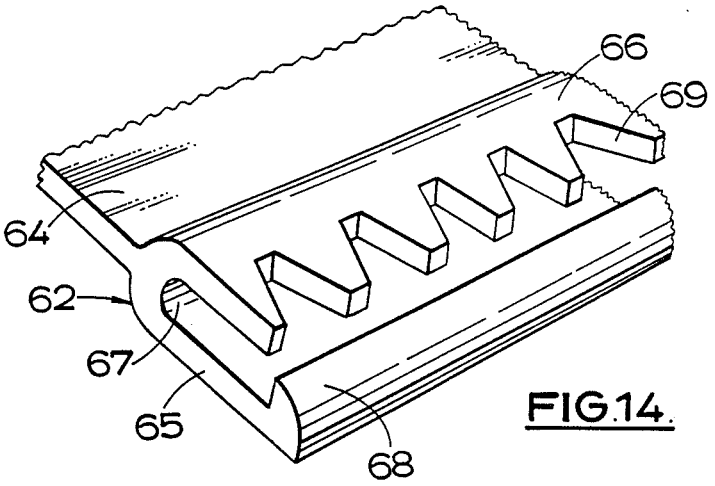
Figure 15:
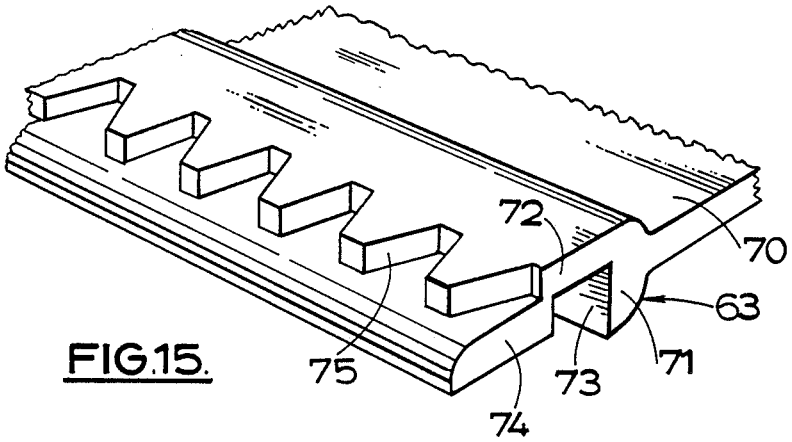
Figure 16:
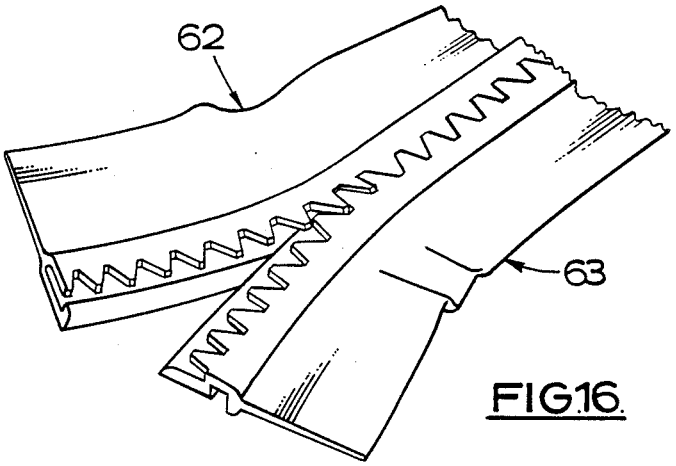
Figure 17:
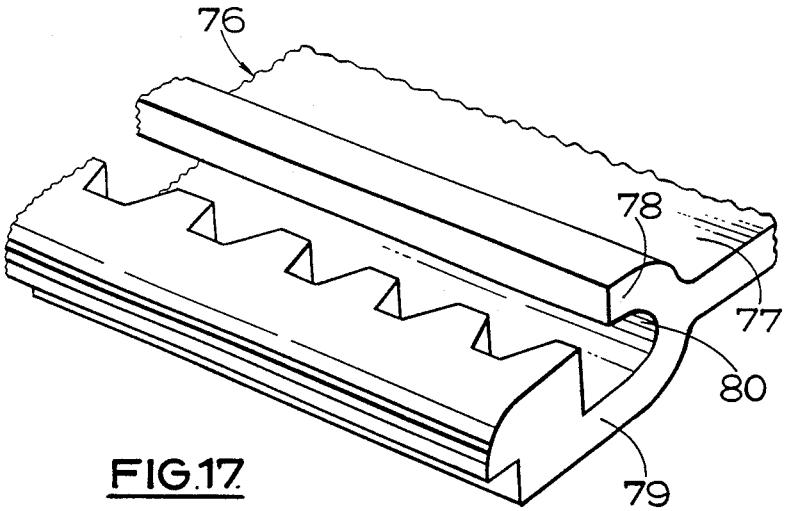
Figure 18:
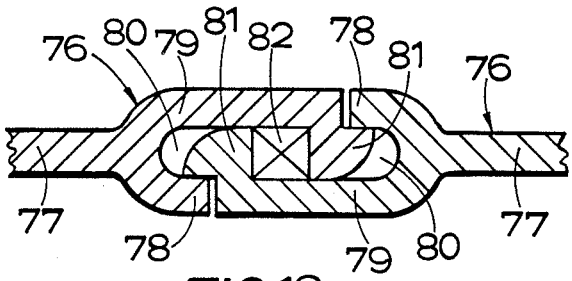
Figure 19:
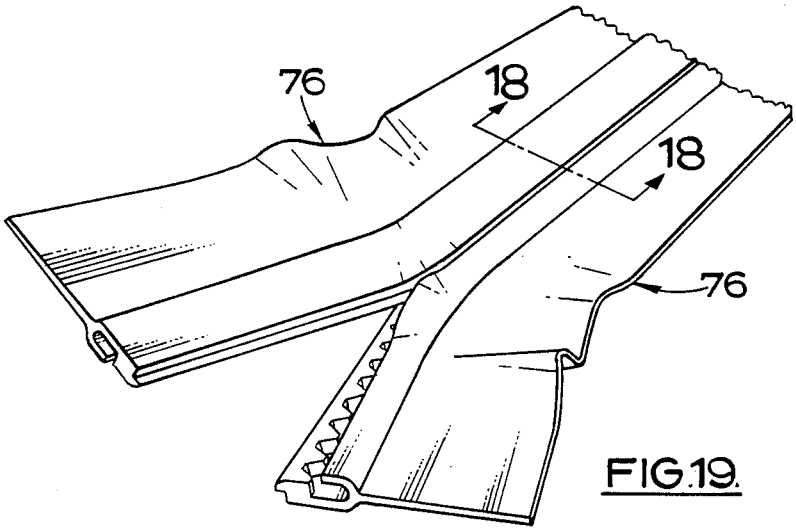
Figure 20:
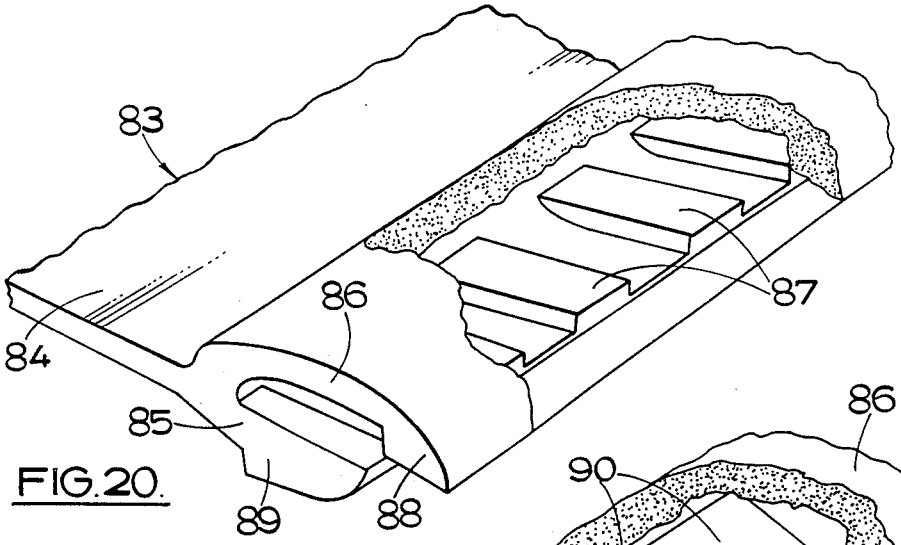
Figure 23:
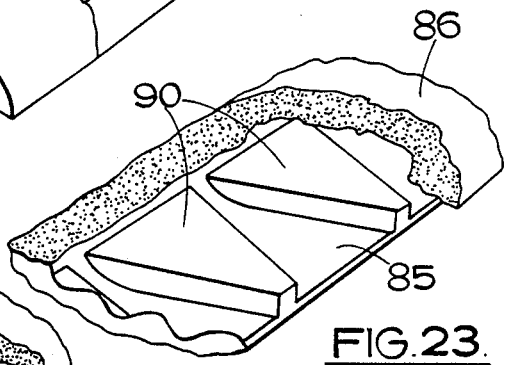
Figure 24:
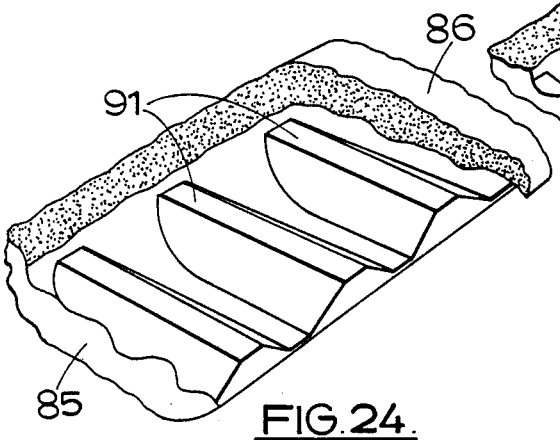
Figure 28:
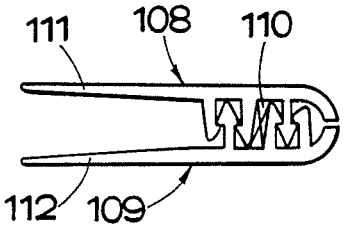
Figure 29:
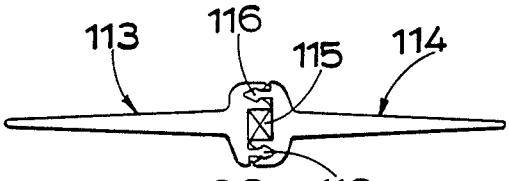
Figure 30:
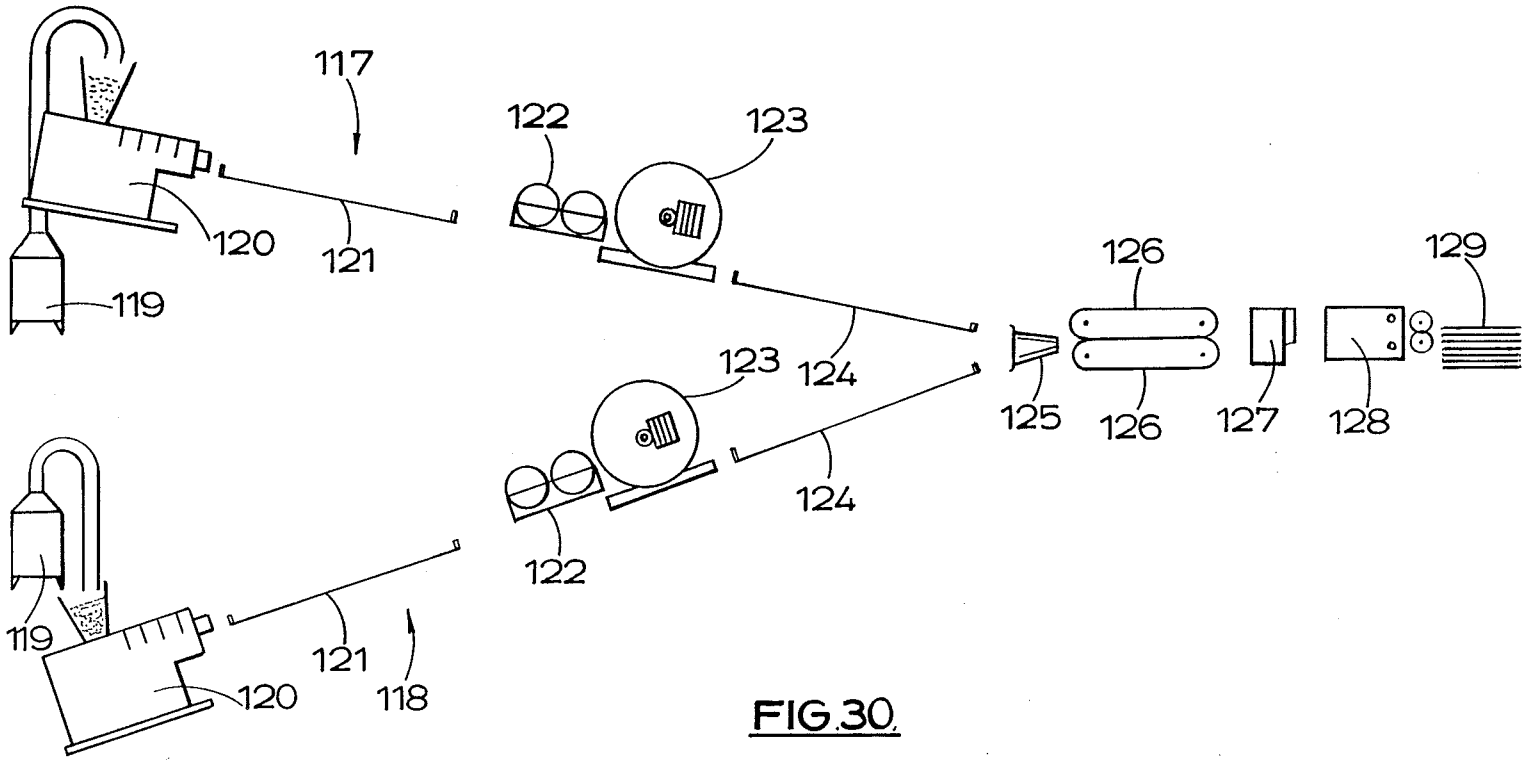

Embodiments of the invention are illustrated, by way of example, accompanying drawings, in which:

FIG. 1 a perspective view of part of a first component of a fastener of a first design embodying invention, FIG. 2 is a perspective view of part of a second component of that fastener, FIG. 3 is a perspective view, to a smaller scale, of part of a fastener of the first design, incorporating components shown in FIGS. 1 and 2, FIGS. 4 to 6 are similar to FIGS. 1 to 3 respectively, but illustrate a fastener of a second the present invention, FIGS. 7 to 9 also similar to FIGS. 1 to 3 respectively, but illustrate a fastener of a third design embodying the present invention, FIG. 10 is a perspective view of an end piece that can be used with a fastener embodying the present invention and the outline of an end portion of a suitable fastener, FIG. 11 is a perspective view of the end piece shown in FIG. 10 from a different viewpoint, FIG. 12 is a perspective view of a slide that forms part of a slide fastener embodying the present invention and of adjacent portions of first and second components of that slide fastener, said portions being illustrated only schematically, FIG. 13 is a perspective view of the slide shown in FIG. 12, from a different view point and with parts broken away and omitted for clarity, FIGS. 14 to 16 are similar to FIGS. 1 to 3 respectively but illustrate a fastener of a fourth design embodying the present invention, FIG. 17 is a perspective view of a component of a fastener that can co-operate with a component of similar shape to form a fastener of a fifth design the present invention, FIG. 18 is a section, to a larger scale, along the line 18—18 of FIG. 19, FIG. 19 is a perspective view of a fastener comprising two components each similar to that shown in FIG. 17, FIGS. 20 to 22 are similar to FIGS. 17 to 19 respectively, but illustrate a fastener of a sixth design embodying the present invention, FIG. 23 resembles part of FIG. 20 but illustrates modification, FIG. 24 resembles part of FIG. 20 but illustrates another modification, FIGS. 25 to 29 are end views of other designs of fasteners, each in accordance with the present invention, and FIG. 30 is a schematic view of plan for use in the manufacture of a fastener in accordance with the present invention.

The fastener shown in FIG. 3 comprises a first component 1 and a second component 2. The first component 1, of which a part is shown in detail in FIG. 1, is of elongated form and is of uniform shape along its entire length. The component 1 is made from a thermoplastic material such as polyvinyl chloride, that is both flexible and resilient. The component comprises a strip 3 at one edge of which is an engagement formation comprising a body comprising parallel side walls 4 and 5 which define between them a groove 6. A lip 7 extends from the side wall 4 to a location part way across the groove so as to leave an open mouth of the groove that is narrower than the interior of the groove. The lip 7, which constitutes a locking formation, is of hook-shaped or undercut cross-section; it has an inner face 8 which is inclined at an acute angle to the adjacent face of the side wall from which the lip projects. An outer part of the lip 7 is chamfered, as shown at 9. The outer face of the side wall 5 is formed with mating formations 10 comprising a row of uniformly spaced projections 11 with recesses 12 between them, the recesses being of a size and shape such that they can receive similarly shaped projections on the second component 2, as described below. Each projection 11 has a stem terminating in a head which is broader than the stem, as shown.

Part of the second component, 2, is shown in FIG. 2. The component 2 is also of elongated form and is of uniform shape along its entire length. The component 2 is made from the same thermoplastic material as that used for making the component 1 and comprises a flexible strip 13, similar to the strip 2, at one edge of which is an engagement formation comprising a body 14 with a planar face 15 normal to the strip 13 and facing away from the strip. A wall 16 projects from a part of the face 15 spaced inwards from the edges of the face. A rib 17 is formed on that edge of the wall remote from the body 14 and projects to one side of the wall. The rib is so shaped as to constitute a locking formation complementary to that of the first component 1; a lower face 18 of the rib is inclined at an acute angle to the adjacent surface of the wall 16. Spaced away from the opposite side of the wall 16 there is a row of uniformly spaced mating formations 19 similar in shape to the mating formations 10 and stemming from the face 15 of the body 14.

The components 1 and 2 can be engaged in the manner shown in FIG. 3. The components can be urged into engagement by the movement of a slide (not shown) but the provision of a slide is not essential. During engagement the rib 1 engages the chamfered surface 9 and deflects the side wall 4 resiliently aside until the rib is entirely within the groove 6, whereupon the side wall 4 snaps back. At the same time the projections of each of the rows of mating formations 10 and 19 snap into the recesses of the other mating formation. The side wall 5 enters between the wall 16 and the mating formations 19.

When the components 1 and 2 are fully engaged, any attempt to disengage them by exerting tension on the strips 3 and 13, so as to pull them away from each other and to pull the rib 17 from the groove 6, is positively resisted by the engagement between the faces 8 and 18. Moreover, the interlock between the mating formations 10 and 19, though less positive, also assists in resisting the disengagement of components. As the inner face 8 of the lip 7 and the lower face 18 of the rib 17 are inclined (the inclinations in fact being equal), the engagement between those faces tends to urge the mouth towards a closed state and thus further to assist in resisting withdrawal of the rib from the groove.

The components 1 and 2 can be progressively engaged and disengaged along their lengths as indicated in FIG. 3, in which portions of the components to the right of the Figure are shown engaged together and portions of the components to the left are shown disengaged. In an intermediate zone the components are partially engaged. By suitable manipulation of the components the intermediate zone can be caused to progress either towards the left, until the components are fully engaged, or to the right, until the components are fully disengaged. This progressive engagement and disengagement can conveniently be effected with the aid of a slide generally similar to the slide of a conventional slide fastener. The slide may, for example, be of the kind described below and illustrated in FIGS. 12 and 13. As in a conventional slide fastener those parts of the components to one side of the slide are engaged and those parts to the other side are disengaged.

The first component, 1, is made in a series of steps, the first of which is an extrusion process in which a blank is extruded. The blank comprises the strip 3 and portions that are subsequently to form the side walls 4 and 5 and the mating formations 10. Those portions are spaced apart, on opposite sides of the strip 3, and are substantially at right angles thereto. The lip 7 is also formed in the extrusion process. In a second step of the process the mating formations 10 are sequentially formed from one portion of the blank. This shaping process may be effected by passing the portion of the blank between suitably shaped roller dies. In a third step the portions are brought into parallel relationship, as shown, so as to constitute the side walls 4 and 5 and the mating formations 10.

The second component, 2, is made in a generally similar manner. In a first, extrusion step, the strip 13, body 14, wall 16 and rib 17 are formed together with a second wall, which in a subsequent step is passed between suitably shaped roller dies to provide the mating formations 19.

The thermoplastic material from which the components are made are particularly suitable for the manufacture of the components in steps of the kind described. The techniques of extrusion are so well understood as to require no further description here, and likewise the passage of extruded material past a rotating die, while the material is still hot and capable of being formed by the die, is known in a technique referred to as post-forming. In the manufacture of the components, the material from which they are made is preferably retained at an appropriate temperature throughout the manufacture and cooled only when all the steps have been completed. Nevertheless, it would be possible to allow the extruded blank to cool and then to reheat it before it passes the rotating die.

Figure 4:
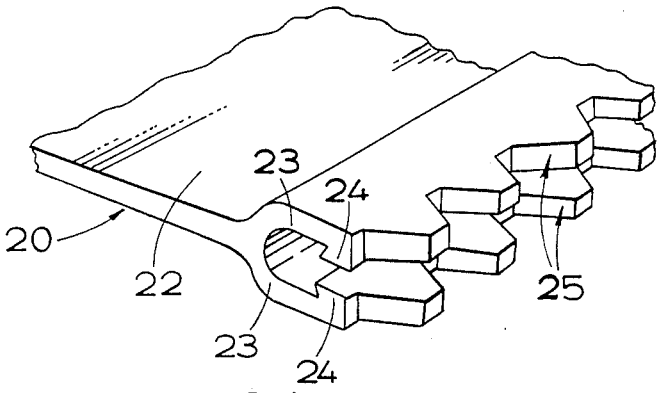

Turning now to the fastener components illustrated in FIGS. 4 to 6, FIG. 4 shows a first component, 20, which co-operates with a second component, 21, shown in FIG. 5. The first component,20, is in part similar to the first component 1 in that is has a strip 22 similar to the strip 3 and a body with side walls 23 each similar to the side wall 4 and provided with a lip 24 similar to the lip 7, apart from the absence of any chamfering. Mating formations 25 extend from the tops of the walls 23 and comprise teeth in the shape of blunt triangles, with spaces between the teeth of a shape similar to those of the teeth. The teeth are slightly tapered so as to be thinner at their crests than at their roots. The second component, 21, has a strip 26 similar to the strip 13 and a body 27 at one edge there of. The body comprises a central wall 28, constituting a continuation of the strip 26, with mating formations 29 on each side of it and with a rib 30 at its free edge, spaced from the mating formations. The mating formations are of the same blunt triangular shape as the mating formations 25. The rib 30 is of tapered cross-section and has inclined lower faces 31 each similar to the lower face 18.

The components 20 and 21 can engage each other in the manner shown in FIG. 6. When the components are urged together the narrow ridge of the tapered rib 30 enters between the mating formations 25 and urges them resiliently apart. The side walls 23 are also urged apart and eventually the rib 30 is wholly contained within the groove between the side walls 23, whereupon the walls snap back into their original positions, and the lips 24 engage the lower surfaces 31 of the rib and resist disengagement of the components. At the same time that the rib is entering the groove the mating formations 25 and 29 interengage each other. The mating formations prevent relative longitudinal movement between the components but do not interlock. Resistance to disengagement of the components is therefore effected solely by the engagement between the lips 24 and the rib 30.

As with the fastener shown in FIG. 3, the fastener shown in FIG. 6 can be caused to engage and disengage with the aid of a slide (not shown).

The components 20 and 21 are made by multi-step processes, similar to those described above. In the first step blanks are extruded, and in a second step the mating formations are formed from the extruded blanks by passage past a rotating die. In the manufacture of the first component, 20, there is a third step in which the side walls 23 with their locking formations 25 are brought from a co-planar state to a parallel state.

It is to be understood that, if desired, mating formations similar in profile to the mating formations 15 and 19 may be used in place of the mating formations 25 and 29. Conversely, mating formations similar in profile to the mating formations 25 and 29 may be used in place of the mating formations 10 and 19.

The fastener components shown in FIGS. 7,8 and 9 are in part similar to the components described above with reference to FIGS. 1 to 6. A first component, 32, is shown in FIG. 7 and a second component, 33, in FIG. 8. The first component, 32, has a strip 34 at one edge of which is formed a body comprising side walls 35 defining between them a groove 36. Each side wall has an inwardly directed lip 37 of triangular cross-section, the lower face 38 of which is inclined so as to form an undercut, as shown. Mating formations 39 are provided near the bottom of the groove 36 and comprise part-circular teeth extending transversely of the groove. Each tooth is narrower at the crown than at the root. The second component, 33, comprises a strip 40, similar to the strip 34, with a rib 41 extending along one edge thereof. The rib is shaped to fit into the groove 36 and each of its lower faces 42 is inclined at an acute angle to the adjacent face of the strip 40 so as to enter one of the undercuts beneath the lips 37. The rib 41 is formed with mating formations 43 complementary to the mating formations 39.

The components 32 and 33 can be engaged and disengaged in the manner illustrated in FIG. 9 with the aid of a slide. When the components are engaged the engagement between the lower faces 38 of the lips 37 and the lower faces 42 of the rib 41 resist any forces trying to pull the components apart, while the mating formations 39 and 43, which interengage each other, prevent relative longitudinal movement between the components.

The components 32 and 33 are made in multi-step processes similar to those described above. Blanks are first formed by extrusion. Then the mating formations 39 and 43 are formed from the material of the blanks. Finally, in the case of the first component, 32, the side walls 35 are brought from the spaced state to the state illustrated in FIG. 7.

Any of the components described above with reference to the accompanying drawings may be modified in such a manner that the material from which the strip is formed is different from the material from which the remainder of the component is formed. This can be effected by means of the co-extrusion of the blanks.

In each of the three embodiments of components illustrated, the fastener, when engaged, is water-proof or at least substantially water-proof, as it is difficult or impossible for the water to pass from one side of the faster to the other through the groove. In order to enhance the resistance to fluid flow, the arrangement may be such that when the components are engaged there is no free play possible between them; in addition, one of the components may be resiliently deformed so as to bear positively on the other to provide a seal.

As with conventional slide fasteners, the two components may be permanently secured together at one end of the fasteners. This may be achieved by anchoring adjacent end portions of the components in an end piece. A suitable end piece 44 is shown on FIGS. 10 and 11 and comprises a unitary moulding of a plastics material. The end piece is of grooved shape to receive the end portions of the engaged components. A central part 45 of the end piece is of greater width than side parts 46. The walls of the central part are formed with barb-like projections 47 which allow the end of the components to be inserted into the central part but strongly resist their withdrawal. The central part 45 is formed with an opening 48, at the bottom of the groove. When the end piece is being moulded, a tool extends through the opening 48 and defines the end faces of the projections 47. FIG. 10 includes an outline of an end portion of a pair of components engaged together. Strips 49 thereof enter the side parts 46 of the end piece, and the thicker part 50 between the strip enters the central part 45. The end piece may be adhesively secured in position.

A slide 51 is shown in FIGS. 12 and 13 and is of substantially conventional form comprising a body 52 and a pull-tag 53 pivoted to the body. The body comprises a pair of parallel plates 54 broader at one end than the other and spaced apart by a pillar 55 nearer the broader ends of the plates. Flanges 56 at the side edges of one plate are directed towards similar flanges on the other plate but there are gaps remaining between the adjacent flanges. A transverse hole through the pull-tag 53 receives trunions 57 mounted on one of the plates 54. FIG. 12 shows, somewhat diagrammatically, parts of two components 58 and 59 each with a strip 60 and thicker portion 61 extending along one edge thereof. The thicker portions may be shaped in any of the ways described above so that they can be engaged and disengaged. The pillar 55 extends between the components, which are therefore disengaged, but the thicker portions are held against the pillar by the adjacent, parts of the flanges 56. At the narrower ends of the plates 54 the adjacent parts of the flanges hold the thicker portions in engagement. Longitudinal movement of the slide relative to the components causes progressive engagement or disengagement of the components as in a conventional slide fastener.

A fourth design of fastener is illustrated in FIGS. 14 to 16 and comprises two components 62 and 63. The components are generally similar to those described above and illustrated in FIGS. 1 to 9 but differ in detail. The component 62 comprises a strip 64 at one edge of which is a body comprising parallel side walls 65 and 66 which define between them a groove 67. Wall 65 is formed with a lip 68 constituting a locking formation, while wall 66 is formed with mating formations 69. Component 63 comprises a strip 70 with a body 71 at one edge from which projects a wall 72. An inner part of the wall is formed with a lateral groove 73, while an outer part of the wall constitutes a rib 74 and mating formations 75, which are on the opposite side of the wall from the groove 73. When the components 62 and 63 are engaged, the rib 74 enters the groove 67, the mating formations 69 and 75 interengage, and the lip 68 enters the groove 73. It will be appreciated that the lip 68 may be thought of as also constituting a rib that enters a groove and that in consequence each of the components serves both as a first component and as a second component. As with the fasteners described above, the fastener shown in FIG. 16 may be operated with a slide.

FIGS. 17 to 19 illustrate a fifth design of fastener. In this instance, however, the two components are of identical shape so that each may be considered as constituting a first component and a second component. The component 76 shown in FIG. 17 is generally similar to those described above but differs from them in detail. It comprises a strip 77 formed at one edge with spaced parallel walls 78 and 79 defining between them a groove 80. Wall 79 carries at its free edge a portion that is offset laterally from the wall; that portion comprises a rib 81 which projects in a direction away from the groove 80, and mating formations 82 which project towards the groove. As shown in FIG. 18, when two components, each similar to the component 76, are engaged, the rib 81 of each component enters the groove 80 of the other component, while the mating formations 82 interengage. In FIG. 18, the interengaging mating formations are indicated by a rectangle with a cross in it. The fastener, part of which is shown in perspective in FIG. 19, can be operated with a slide.

Figure 21:
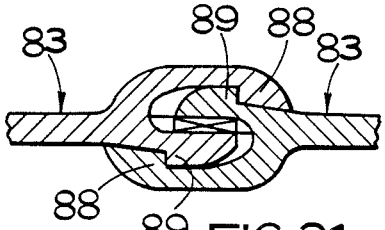
Figure 22:
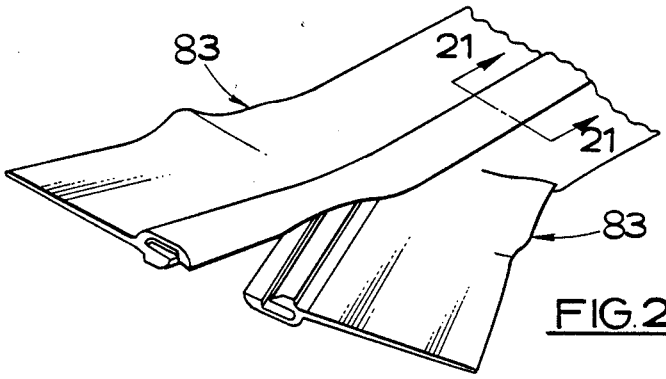

FIGS. 20 to 22 illustrate a sixth design of fastener. Again, it comprises two components of identical shape that are generally similar to the components described above. The component 83 shown in FIG. 20 comprises a strip 84 formed at one edge with spaced parallel walls 85 and 86. The inner face of wall 85 is formed with mating formations 87, while the outer face of wall 85 is formed with a rib 88. Wall 86 is taller than wall 85 and carries at its free edge a retaining formation 89 that is offset from the wall towards the wall 85. The wall 86 and retaining formation 89 define a groove that opens laterally into the gap between the walls. As shown in FIG. 21, two components, each similar to the component 83, can together constitute a fastener. When the components are engaged, the rib 88 on each component enters the groove in the other component, while the mating formations 87 interengage. If tension is applied to the strips, engagement between the ribs 88 and the retaining formations 89 prevent the components separating. If desired the mutually abutting faces may be undercut, like faces 8 and 18 in FIGS. 1 and 2, further to resist separation. The fastener, like those described above, may be operated with a slide.

FIGS. 23 and 24 illustrate alternative shapes of mating formations, 90 and 91 respectively, either of which may be used in place of the mating formations 87.

Each of FIGS. 25 to 29 shows in end view a different form of fastener embodying the invention, interengaging mating formations being illustrated by a quadrilateral with a cross in it. Each fastener comprises a first component and a second component each of which is generally similar to the components described above.

Figure 25:
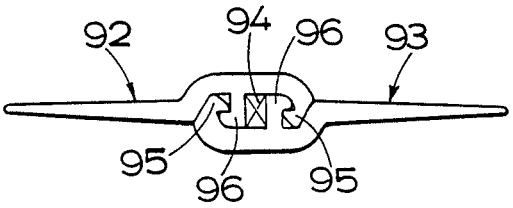

The fastener of FIG. 25 has first and second components 92 and 93 that are identical in shape to each other. In addition to mating formations 94 each component has two parallel grooves and two ribs 95 and 96 that enter the grooves in the other component.

Figure 26:
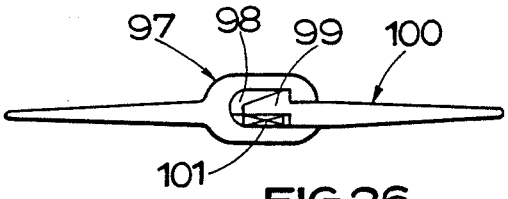

The fastener of FIG. 26 has a first component 97 formed with a groove 98 which receives a rib 99 on a second component 100. Mating formations 101 are formed on the component.

Figure 27:
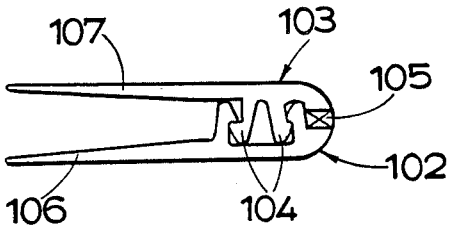

The fastener of FIG. 27 has a first component 102 and a second component 103. A groove in the first component receives two ribs 104 on the second component while mating formations 105 interengage. This fastener differs from previously described fasteners in that strips 106 and 107 of the respective components project in parallel on the same side of the mutually engaging formations.

The fastener of FIG. 28 has a first component 108 and a second component 109. Each component has at least two grooves entered by a complementary rib on the other component interengaging mating formations 110 extend between the grooves and ribs. As with the fastener of FIG. 27, strips 111 and 112 project in parallel on the same side of the mutually engaging formations.

Finally, the fastener of FIG. 29 comprises first and second components 113 and 114 which are of identical shape and form. Each has mating formations 115 lying between a groove and a rib 116 that enters the groove in the other component.

It will be clear from a study of FIGS. 25 to 29 that in each instance the formations include interlocking parts releasably secure the components together.

Although a wide variety of fasteners in accordance with the invention have been described, it will be apparent that other variations are possible without departing from the scope of the present invention. In particular, features of some of the fasteners described and illustrated can be substituted for the corresponding features of others of the fasteners in order to yield yet further designs of fasteners. In each instance, the fasteners may be used with or without slides, as desired. Further, in each instance, the strip constituting part of a component may be formed from a material different from that from which the remainder of the fastener, or engagement formation, is formed.

FIG. 30 is a schematic illustration of plant suitable for use in making a fastener in accordance with the present invention. The plant is shown as having a first line 117 for making a first component and a second line 118 for making a second component. The lines are similar, and each comprises a source 119 of granular plastics material that is fed to a variable-speed extruder 120 which extrudes a blank of suitably shaped cross-section, as outlined above. This is cooled in passing through a primary cooler 121 from which it emerges in a self-supporting state. That portion of the blank that is to be further shaped is then heated by rotary heaters 122, using a combination of radiant and contact heating. The blank next passes a forming wheel or rotary die 123, which is cooled so that the mating formations are created in the blank and set in one forming operation. The blank passes next through a final cooler 124 which removes all residual heat.

The two blanks from the two lines are caused to engage each other as they pass through a combiner 125 somewhat similar in construction to a slide. The engaged fastener is pulled through the combiner between power-driven endless bands 126. The fastener is cut into lengths by a rotary fly knife 127. Finally the straightness of the fastener is gauged by an optical device 128 incorporating photo-cells. Information from the device is passed to a control system (not shown) which generates signals which vary the rate of operation of the extruders 120 and the rate of rotation of the forming wheels 123 and the rate of movement of the bands 126. Variation in the relative speed of the motor driving one of the forming wheels 123 and the motor driving the bands 126 varies the extent to which the component concerned is stretched and thus varies the spacing between the mating formations of that component. The finished fasteners are stacked at 129.

Although it is not illustrated, there may be shaping means operative to shape a component after it has passed the forming wheel 123. When shaping means is employed, the extruded blank is of a cross-section such that the portion of the blank on or in which the mating formations are to be formed is so presented as to be readily accessible to the rotary die. After the mating formations have been formed, the shaping means then operates to bring the parts of the component into the relative positions that they will occupy in the completed component. The shaping means may comprise a stationary guide which progressively causes the reshaping of the component as the component moves past it.

Any of the fasteners described above with reference to the accompanying drawings may be made by a process of the kind described.

It will be appreciated that in each embodiment, longitudinally extending surfaces of the components engage each other, when the components are engaged, and form a seal which renders the fastener at least substantially fluid-resistant. The arrangement is preferably such that, when the components are engaged, those sealing surfaces do not merely touch each other but are urged into contact with each other as the result of resilient deformation of at least one of the components.

I claim:

1. A fastener comprising a first component and a second component which can be releasably engaged with the first component, the first component comprising a first longitudinally extensive engagement formation made of a flexible and resilient material and a first substantially planar, longitudinally extensive attachment portion extending from said first engagement formation, said first engagement formation comprising a pair of mutually spaced body portions extending away from said first attachment portion in a direction parallel with said first attachment portion and defining between inner faces thereof a groove with a longitudinally extensive mouth spaced away from said first attachment portion, first abutment means presenting first abutment face means transverse to said first attachment portion and facing in a direction towards rather than away from said first attachment portion, and a plurality of first longitudinally spaced mating formations, and the second component comprising a second longitudinally extensive engagement formation made of flexible and resilient material and a second substantially planar, longitudinally extensive attachment portion extending from said second engagement formation, said second engagement formation comprising a longitudinally extensive rib extending away from said second attachment portion in a direction parallel with said second attachment portion and of a size to fit into said groove, second abutment means presenting second abutment face means transverse to said second attachment portion and facing in a direction towards rather than away from said second attachment portion, and a plurality of second longitudinally spaced mating formations, each of said first and second components being of the same shape and form as tho other and the arrangement being such that the components can be engaged by relative movement towards each other in a direction parallel with the first and second attachment portions and with temporary flexure of the engagement formations so that the rib enters the groove, the first and second abutment faces of the first and second abutment means abut one another to resist separation of the components and the first and second mating formations engage one another to preclude relative longitudinal movement between the components.

2. A fastener comprising a first component and a second component which can be releasably engaged with the first component, the first component comprising a first longitudinally extensive engagement formation made of a flexible and resilient material and a first substantially planar, longitudinally extensive attachment portion extending from said first engagement formation, said first engagement formation comprising a pair of mutually spaced body portions extending away from said first attachment portion in a direction parallel with said first attachment portion and defining between inner faces thereof a groove with a longitudinally extensive mouth spaced away from said first attachment portion, first abutment means presenting first abutment face means transverse to said first attachment portion and facing in a direction towards rather than away from said first attachment portion, and a plurality of first longitudinally spaced mating formations, and in the second component comprising a second longitudinally extensive engagement formation made of flexible and resilient material and a second substantially planar, longitudinally extensive attachment portion extending from said second engagement formation, said second engagement formation comprising a longitudinally extensive rib extending away from said second attachment portion in a direction parallel with said second attachment portion and of a size to fit into said groove, second abutment means presenting second abutment face means transverse to said second attachment portion and facing in a direction towards rather than away from said second attachment portion, and a plurality of second longitudinally spaced mating formations, the arrangement being such that the components can be engaged by relative movement towards each other in a direction parallel with the first and second attachment portions and with temporary flexure of at least the first engagement formation so that the rib enters the groove, the first and second abutment faces of the first and second abutment means abut one another to resist separation of the components and the first and second mating formations engage one another to preclude relative longitudinal movement between the components, and when the fastener is assembled, the first and second attachment portions lie in a common plane, and the mutually abutting first and second abutment face means extend on both sides of said common plane.

3. A fastener comprising a first component and a second component which can be releasably engaged with the first component, the first component comprising a first longitudinally extensive engagement formation made of a flexible and resilient material and a first substantially planar, longitudinally extensive attachment portion extending from said first engagement formation, said first engagement formation comprising a pair of mutually spaced body portions extending away from said first attachment portion in a direction parallel with said first attachment portion and defining between inner faces thereof a groove with a longitudinally extensive mouth spaced away from said first attachment portion, first abutment means presenting first abutment face means transverse to said first attachment portion and facing in a direction towards rather than away from said first attachment portion, and a plurality of first longitudinally spaced mating formations, and the second component comprising a second longitudinally extensive engagement formation made of flexible and resilient material and a second substantially planar, longitudinally extensive attachment portion extending from said second engagement formation, said second engagement formation comprising a longitudinally extensive rib extending away from said second attachment portion in a direction parallel with said second attachment portion and of a size to fit into said groove, second abutment means presenting second abutment face means transverse to said second attachment portion and facing in a direction towards rather than away from said second attachment portion, and a plurality of second longitudinally spaced mating formations, each of said first and second components being symmetrical about the plane of its attachment portion and the arrangement being such that the components can be engaged by relative movement towards each other in a direction parallel with the first and second attachment portions and with temporary flexure of at leas the first engagement formation so that the rib enters the groove, the first and second abutment faces of the first and second abutment means abut one another to resist separation of the components and the first and second mating formations engage one another to preclude relative longitudinal movement between the components.

4. A fastener comprising a first component and a second component which can be releasably engaged with the first component, the first component comprising a first longitudinally extensive engagement formation made of a flexible and resilient material and a first substantially planar, longitudinally extensive attachment portion extending from said first engagement formation, said first engagement formation comprising a pair of mutually spaced body portions extending away from said first attachment portion in a direction parallel with said first attachment portion and defining between inner faces thereof a groove with a longitudinally extensive mouth spaced away from said first attachment portion, first abutment means presenting first abutment face means transverse and inclined to said first attachment portion and facing in a direction towards rather than away from said first attachment portion, and a plurality of first longitudinally spaced mating formations, and the second component comprising a second longitudinally extensive engagement formation made of flexible and resilient material and a second substantially planar, longitudinally extensive attachment portion extending from said second engagement formation, said second engagement formation comprising a longitudinally extensive rib extending away from said second attachment portion in a direction parallel with said second attachment portion and of a size to fit into said groove, second abutment means presenting second abutment face means transverse and inclined to said second attachment portion and facing in a direction towards rather than away from said second attachment portion, and a plurality of second longitudinally spaced mating formations, the arrangement being such that the components can be engaged by relative movement towards each other in a direction parallel with the first and second attachment portions and with temporary flexure of at least the first engagement formation so that the rib enters the groove, the first and second abutment faces of the first and second abutment means abut one another to resist separation of the components and the first and second mating formations engage one another to preclude relative longitudinal movement between the components, and such that when the fastener is assembled and tension is applied to the attachment portions the inclination of the abutment face means tends to urge the components into tight engagement with each other.

5. A fastener component having an elongated engagement formation made of flexible and resilient material and comprising a longitudinally extensive groove, a plurality of longitudinally spaced mating formations and a longitudinally extensive rib, the component being such that together with a fastener component of identical shape and form it can constitute a component of a fastener comprising a first component and a second component which can be releasably engaged with the first component, the first component comprising a first longitudinally extensive engagement formation made of a flexible and resilient material and a first substantially planar, longitudinally extensive attachment portion extending from said first engagement formation, said first engagement formation comprising a pair of mutually spaced body portions extending away from said first attachment portion in a direction parallel with said first attachment portion and defining between inner faces thereof a groove with a longitudinally extensive mouth spaced away from said first attachment portion, first abutment means presenting first abutment face means transverse to said first attachment portion and facing in a direction towards rather than away from said first attachment portion, and a plurality of first longitudinally spaced mating formations, and the second component comprising a second longitudinally extensive engagement formation made of flexible and resilient material and a second substantially planar, longitudinally extensive attachment portion extending from said second engagement formation, said second engagement formation comprising a longitudinally extensive rib extending away from said second attachment portion in a direction parallel with said second attachment portion and of a size to fit into said groove, second abutment means presenting second abutment face means transverse to said second attachment portion and facing in a direction towards rather than away from said second attachment portion, and a plurality of second longitudinally spaced mating formations, the arrangement being such that the components can be engaged by relative movement towards each other in a direction parallel with the first and second attachment portions and with temporary flexure of at least the first engagement formation so that the rib enters the groove, the first and second abutment faces of the first and second abutment means abut one another to resist separation of the components and the first and second mating formations engage one another to preclude relative longitudinal movement between the components.

* * * * *